US009837240B1

(12) United States Patent
Schamiloglu et al.

(10) Patent No.: US 9,837,240 B1
(45) Date of Patent: Dec. 5, 2017

(54) RELATIVISTIC MAGNETRON WITH NO PHYSICAL CATHODE

(71) Applicants: Edl Schamiloglu, Albuquerque, NM (US); Mikhail I. Fuks, Albuquerque, NM (US)

(72) Inventors: Edl Schamiloglu, Albuquerque, NM (US); Mikhail I. Fuks, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 184 days.

(21) Appl. No.: 14/742,634

(22) Filed: Jun. 17, 2015

Related U.S. Application Data

(60) Provisional application No. 62/013,425, filed on Jun. 17, 2014.

(51) Int. Cl.
*H01J 23/20* (2006.01)
*H01J 25/50* (2006.01)

(52) U.S. Cl.
CPC ..... *H01J 23/20* (2013.01); *H01J 25/50* (2013.01)

(58) Field of Classification Search
USPC ..... 315/39.51
See application file for complete search history.

(56) References Cited

U.S. PATENT DOCUMENTS 5,162,698 A * 11/1992 Kato ..... H01J 25/587 313/346 R
7,245,082 B1 * 7/2007 Fleming ..... H01J 23/05 315/39.67
7,696,696 B2 * 4/2010 Fuks ..... H01J 25/50 315/39.51
7,893,621 B2 * 2/2011 Schamiloglu ..... H01J 23/05 219/678
8,018,159 B2 * 9/2011 Fuks ..... H01J 23/18 315/34
8,324,811 B1 * 12/2012 Fuks ..... H01J 25/50 315/39.51
8,841,867 B2 * 9/2014 Gilgenbach ..... H01J 23/02 315/501
8,878,433 B1 * 11/2014 Fleming ..... H01J 25/587 315/39.3
2007/0030088 A1 * 2/2007 Fuks ..... H01J 25/50 332/166

(Continued)

OTHER PUBLICATIONS

Faizo et al "Design for a one Gigawatt Annular-Beam Klystron" SLAC PUB 8765 Jan. 2001.*

(Continued)

*Primary Examiner* — Douglas W Owens
*Assistant Examiner* — Srinivas Sathiraju
(74) *Attorney, Agent, or Firm* — Vogt IP; Keith A. Vogt

(57) ABSTRACT

The present invention provides a relativistic magnetron including an anode with an entrant channel, the channel having an input end, an output end and a dimensional discontinuity between the ends. The channel is connected to the magnetron and has an anode defining an interaction space located between the dimensional discontinuity and output end. Also provided is a cathode, located upstream, a spaced distance away from the interaction space towards the input end, the cathode is adapted to send an electron beam into the interaction space where the electron beam forms a virtual cathode in the interaction space.

17 Claims, 3 Drawing Sheets

(56) References Cited

U.S. PATENT DOCUMENTS

| | | | | |
|---|---|---|---|---|
| 2008/0246385 | A1* | 10/2008 | Schamiloglu | H01J 23/05 313/62 |
| 2009/0058301 | A1* | 3/2009 | Fuks | H01J 23/18 315/39.53 |
| 2009/0224610 | A1* | 9/2009 | Fuks | F42B 12/36 307/108 |
| 2012/0187833 | A1* | 7/2012 | Brasile | H01J 23/05 315/39.55 |

OTHER PUBLICATIONS

AA Grishkov et al Annular electron beam with virtual cathode in a coaxial diode with magnetic insulation 2014 J Physics552 (2014) 012018.*

Steven gold et al Review of high power microwave source research Review of sci. Instr. 68 (11) Nov. 1997 p. 3945-3974.*

* cited by examiner $$I_b > I_{lim} + I_a$$

RELATIVISTIC MAGNETRON WITH NO PHYSICAL CATHODE

RELATED APPLICATIONS

Not applicable. This application claims the benefit of U.S. Provisional Application No. 62/013,425 filed Jun. 17, 2014 and herein incorporated by reference.

STATEMENT REGARDING FEDERALLY SPONSORED RESEARCH & DEVELOPMENT

This invention was made with government support under N00014-13-1-0565 awarded by the Office Of Naval Research and under FA9550-15-1-0094 awarded by the Air Force Office of Scientific Research. The government has certain rights in the invention.

INCORPORATION BY REFERENCE OF MATERIAL SUBMITTED ON A COMPACT DISC

Not applicable.

BACKGROUND OF THE INVENTION

Magnetrons are widely used as powerful and compact sources for the generation of high power microwaves in a variety of applications. Such applications may include, but are not limited to, microwave ovens, telecommunications equipment, lighting applications, radar applications, and military and weapons applications.

A conventional relativistic magnetron structure is a coaxial vacuum diode with a cathode having a solid cylindrical surface and an anode consisting of cavities forming an azimuthally periodical resonant system. In many designs, resonator cavities of various shapes are cut into the internal surface of the anode, for example, in a gear tooth pattern. During operation, a steady axial magnetic field fills the vacuum annular region between the cathode and anode, and a high voltage pulse is applied between them to provide conditions for microwave generation. Transverse electric-type (TE) eigenmodes of the resonant system are used as operating waves. Usually two types of oscillations are used, the $\pi$-mode (with opposite directions of electric field in neighbor cavities) and the $2\pi$-mode (with identical directions of electric field in all cavities). The frequency of the generated microwaves is based in part on the number and shape of the resonator cavities, and the design features of the anode and cathode.

A cross-sectional view of a conventional magnetron is illustrated in FIG. 1. As shown, the magnetron comprises an anode 10, a cathode 20, which is a solid cylindrical structure, and resonator cavities 15. In this example, a waveguide 40 is located in one of resonator cavities 15 in order to extract the generated microwaves. A dielectric 40*a* also may be present in the waveguide 40. There are other ways known to those skilled in the art for extracting the microwaves as well, such as, for example, axially using diffraction output.

Electrons emitted from the solid cathode 20 form a solid flow drifting around a cathode with a velocity determined by the applied voltage and magnetic field. When the azimuthal phase velocity of one of eigenmodes of the resonant system is close to the azimuthal drift velocity of the electrons, energy of the electrons is transferred to this electromagnetic wave. As the wave gains energy, fields of the wave backreact on the electron charge cloud to produce spatial bunching of the electrons, which in turn reinforces the growth of the wave.

The lifetime of high power relativistic magnetrons is limited by the intense electron bombardment of the cathodes that leads to their destruction. In relativistic magnetrons with explosive electron emission cathodes, the expanding cathode plasma is one of the reasons for decreasing efficiency and pulse shortening (the presence of EM fields increases the expansion of the cathode plasma by an order or magnitude due to plasma heating). Expulsion of adsorbed gases on the cathode (and anode) from one shot to the next also limits the pulse repetition rate between shots.

BRIEF SUMMARY OF THE INVENTION

In one embodiment, the present invention provides a magnetron with a virtual cathode (VC) in place of a physical cathode.

In other embodiments, the present invention provides a magnetron with a cathode that does not deteriorate over time.

In other embodiments, the present invention provides a magnetron with a physical cathode that is located outside of the interaction space of the magnetron.

In yet other embodiments, the present invention provides an anode that has a discontinuity in size which creates a virtual cathode inside the magnetron as a result of the change in radius creating a region where the current of the electron beam exceeds the space-charge-limiting current.

In further embodiments, the present invention provides a magnetron with a vacuum channel having regions that change in radius to create a region where the current of the electron beam exceeds the space-charge-limiting current so as to create a virtual cathode.

In yet another embodiment, the present invention provides a magnetron having a channel that receives an electron beam that is in communication with a larger radius channel. The larger channel serves as an interaction space where a virtual cathode is formed that may be used to power the magnetron.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

Figure 1:
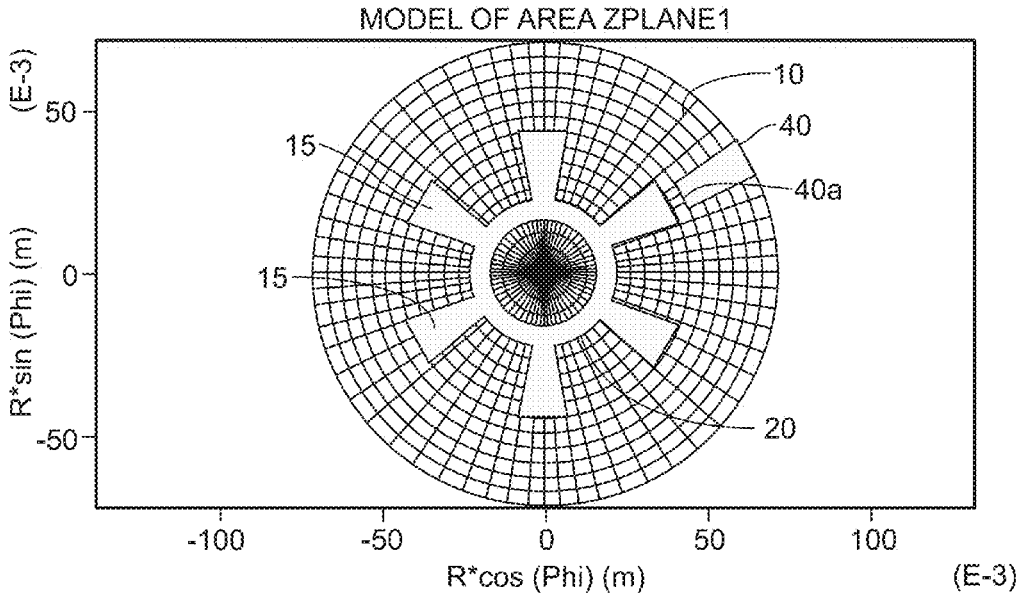
FIG. 1 Prior Art
FIG. 1 is a top view of a conventional prior art magnetron.
Figure 2:
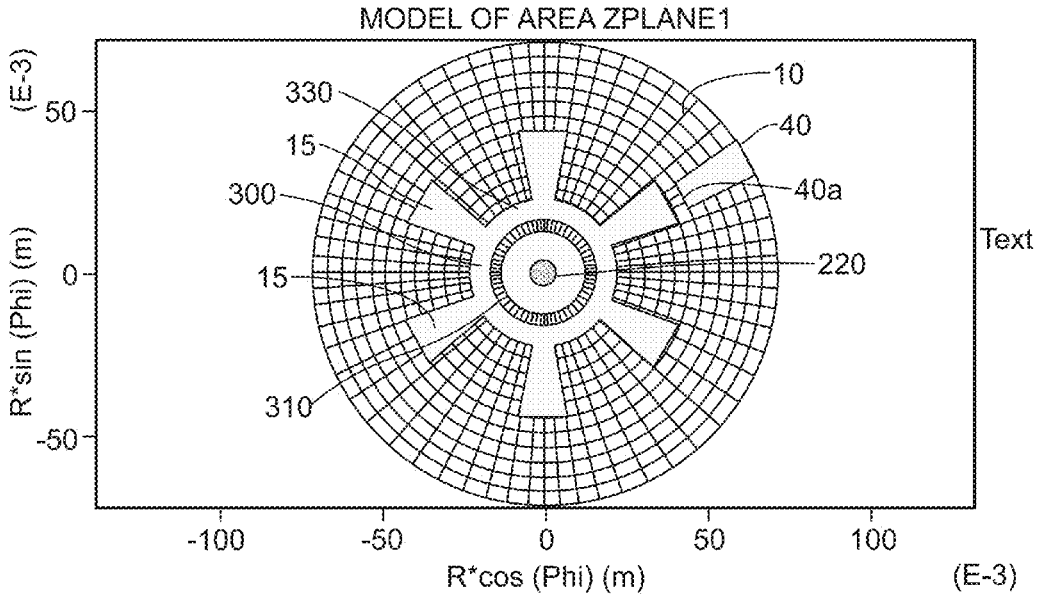
FIG. 2 is a top view of one embodiment of the present invention.
Figure 3:
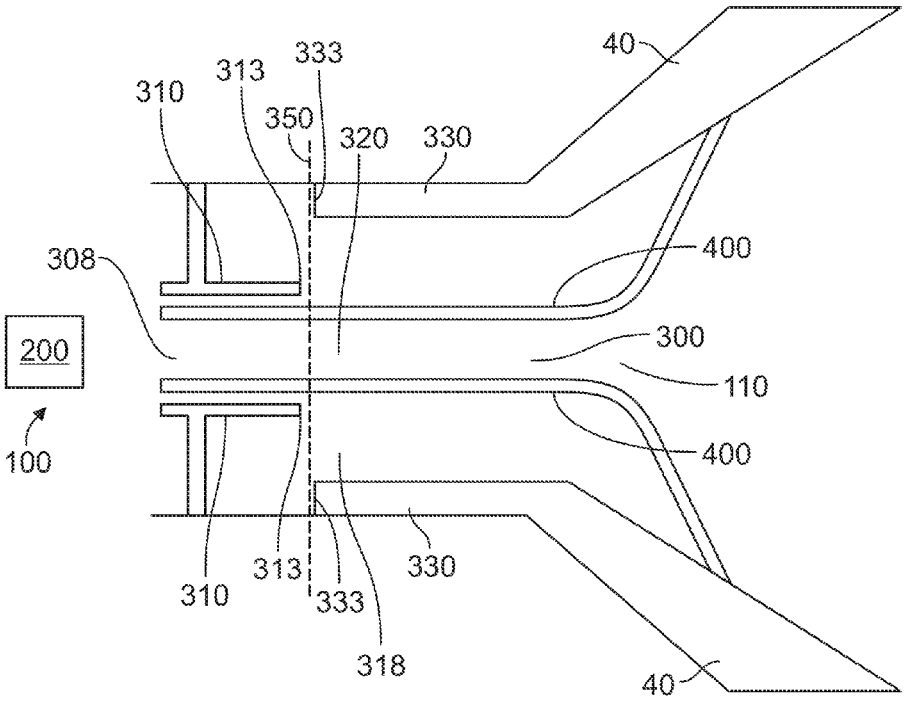
FIG. 3 is a cross-sectional view of the embodiment shown in FIG. 2 with portions removed and showing axial extraction (the so-called magnetron with diffraction output).

As shown in FIGS. 2 and 3, in one embodiment, the present invention provides a magnetron having an anode 10, a virtual cathode 220, which is created from an electron beam from source 200, which may be an electron gun or beam generator, and resonator cavities 15. A vacuum channel 300 is in communication with source 200. As shown, source 200 is a spaced distance outside of the channel.

Channel or passageway 300 provides a path for electron beam 400 to be injected by source 200 into interaction space 320. Passageway 300 transitions from a portion or region 308 defined by section 310 to a larger portion or region 318 defined by section 330. As shown, region 310 may be smaller in radius than region 330 to create a dimensional discontinuity 350 in channel 300.

In a preferred embodiment, as shown in FIG. 2, section 310 is annular and without interruption. Section 330 may also be annular but is segmented by cavities 15. In addition, as shown in FIG. 3, end 313 of section 310 need not be co-extensive with end 333 of section 330. In other embodiments, the ends are co-extensive.

After beam 400 is injected, it first travels through smaller region 308 of passageway 300, and then at end 313, the beam transitions towards the larger radius region 318. At this point, which sits between smaller radius portion 308 and larger radius portion 318, virtual cathode 220 is created, since at this location, the injected current of the electron beam exceeds the space-charge-limiting current.

Thus, when the electron beam is in the smaller radius section, the current does not exceed the space-charge-limiting current $I_{lim}$. However, when the electron beam encounters the larger radius section, the current exceeds the space-charge-limiting current $I_{lim}$, thus forming a virtual cathode.

Therefore, in operation, instead of a physical cathode that is inside the magnetron, an electron beam is injected into the cavity or vacuum channel of the magnetron. The dimensions of the vacuum channel are such that the electron beam forms a virtual cathode (and the electrons essentially stop) right where a physical cathode would be located which is near the area where the dimensional discontinuity 350 occurs which may be created by configuring the channel to change in size from a smaller region to a larger region. The discontinuity may, in a preferred embodiment, result from changes in the radius of the channel. Thus, one of the advantages of the present invention is that the magnetron no longer suffers from cathode plasma expansions (which limits the pulse duration of the magnetron) since there is no longer a physical structural cathode in the interaction space.

The present invention also has the advantage of a transparent cathode in that the microwave RF electric field goes to zero on-axis and not on the surface of traditional cathodes. Since the electron beam is injected upstream from the magnetron, the electron source does not suffer ion back bombardment and other ill-effects of a cathode in a magnetron. This invention revolutionizes long pulse, high power, high repetition rate microwave generation. The current invention also operates with increased efficiency, even when compared to a magnetron with a transparent cathode.

In addition, it has been found that the virtual current forms several nanoseconds after the rise time of the applied voltage when the electron beam current significantly exceeds the space-charge-limiting current. In addition, in spite of the absence of a plane of injection, the virtual current position remains inside the channel with the larger cross section when a narrow channel with a cathode is connected to the wider channel. While sections 310 and 330 are annular in a preferred embodiment, other cross sectional shapes may be used as well.

Figure 5:
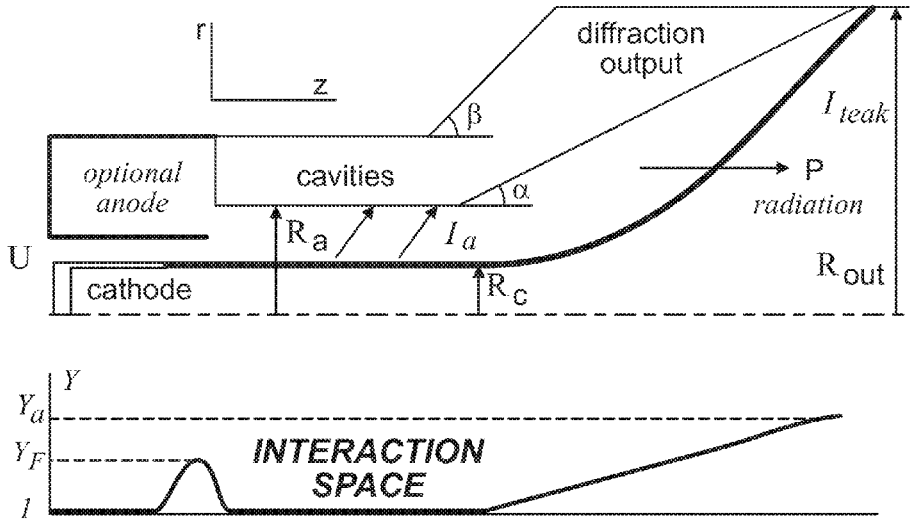
FIG. 5 shows how the larger radius channel can be the interaction space of a relativistic magnetron with diffraction output, and how that virtual cathode can be used to power the magnetron.

As shown in FIG. 5, there are two relevant current limits. One is when the cathode generating the electron beam is very close to the magnetron (as in FIG. 5), which is called the Fedosov current, $I_F=I_b$:

$$I_b = I_0 \frac{(\Gamma - \gamma_b)}{\gamma_b} \frac{\sqrt{\gamma_b^2 - 1}}{2\ln\left(\frac{R_a}{R_c}\right)}$$

where $$I_0 = \frac{mc^3}{e} \approx 17{,}000 \text{ Amperes},$$

$\Gamma=1+eU/mc^2$, $\gamma_b=-0.5+\sqrt{2\Gamma+0.25}$ is the relativistic Lorentz factor for a beam with the Fedosov current, m is the electron mass, e is the electron charge, c is the speed of light in vacuum, $R_c$ is the cathode radius, $R_a$ is the anode radius, and U is the electrostatic potential (voltage) of the anode.

The other current limit is for the case where the electron beam is injected further upstream from the magnetron, and for a solid beam of radius $R_b$ this axial space-charge-limiting current is $$I_{SCL} = I_0 \frac{(\gamma^{2/3} - 1)^{3/2}}{1 + 2\ln\left(\frac{R_a}{R_b}\right)}$$

In other embodiments, a sufficient discontinuity may be established where the limiting current depends inversely on the ln $$\left(\frac{R_a}{R_b}\right)$$

where $R_b$ is the radius of the electron beam (which also happens to be the cathode radius when cathode is close to the magnetron).

Figure 4:
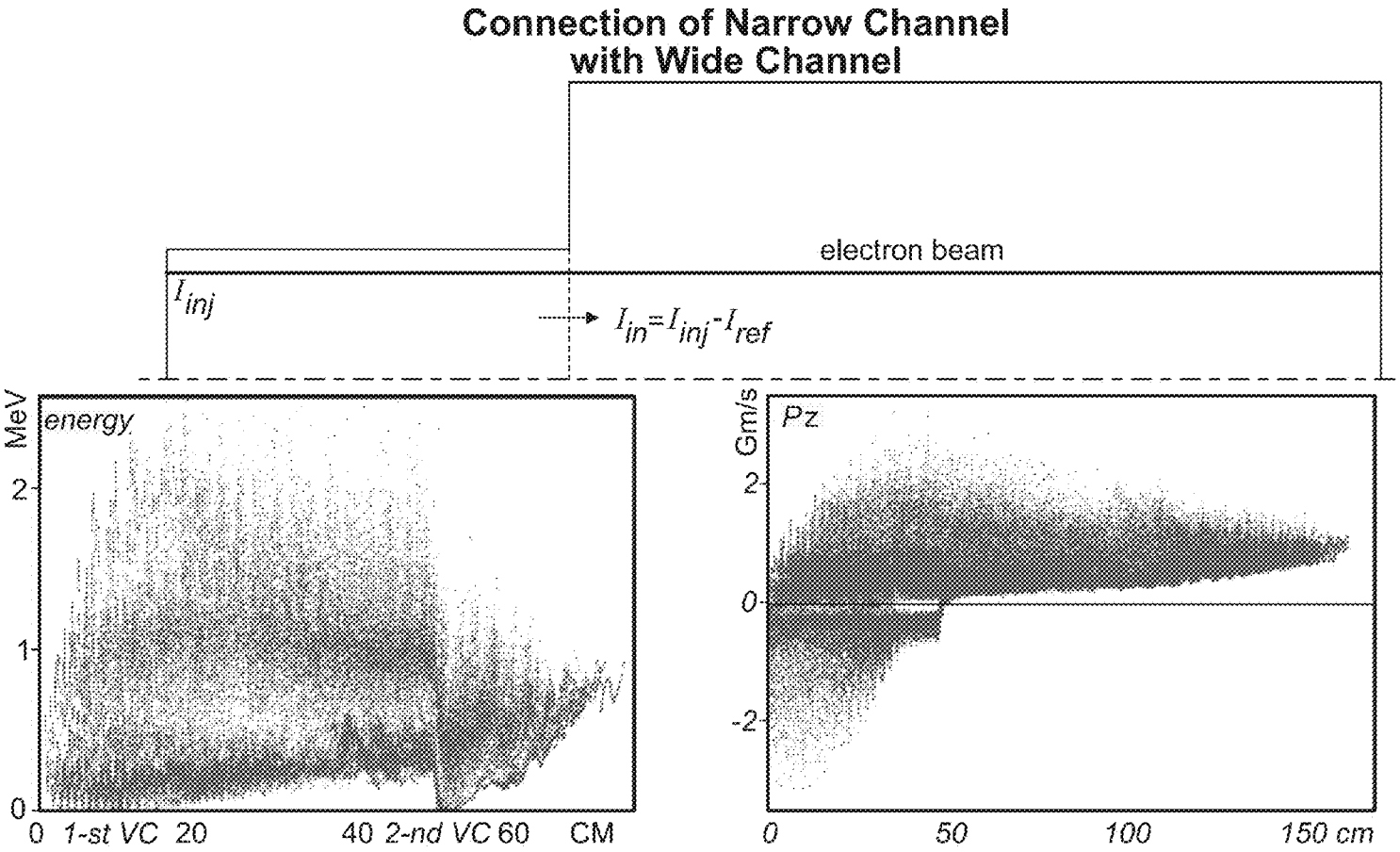
FIG. 4 shows how a virtual cathode is formed in a vacuum channel. In the top an electron beam is injected into a smooth-walled channel from a cathode that is located external to the larger radius channel. The bottom left image from a particle-in-cell computer simulation shows the electron energy as a function of distance from the physical cathode to the larger radius vacuum channel. Zero energy corresponds to the virtual cathode formation and the region of the virtual cathode.

FIG. 4 shows how a virtual cathode is formed in a vacuum channel. In the top an electron beam is injected into a smooth-walled channel from a cathode that is located external to the larger radius channel. The bottom left image from a particle-in-cell computer simulation shows the electron energy as a function of distance from the physical cathode to the larger radius vacuum channel. Zero energy corresponds to the virtual cathode formation and the region of virtual cathode. FIG. 5 shows how the larger radius channel can be the interaction space of a relativistic magnetron with diffraction output, and how that virtual cathode can be used to power the magnetron.

In other embodiments, the present invention provides a relativistic magnetron including an anode with an entrant channel; the channel has an input end, an output end and a dimensional discontinuity between the ends. The channel is connected to the magnetron anode, which defines an interaction space located between the dimensional discontinuity and output end. Also provided is a cathode that may be located upstream a spaced distance away from the interaction space towards the input end. The cathode is adapted to send an electron beam into the interaction space where the electron beam forms a virtual cathode in the interaction space. A dimensional discontinuity may also be created by having a first region in communication with a second region and the first region has a smaller radius than the second region. In other embodiments, the first region may be connected to the second region. The channel may also be cylindrical and the first region has a smaller radius than the second region. In other embodiments, the cathode is externally located with respect to the second region and inside the entrant channel. In yet other embodiments, the cathode is externally located with respect to the second region and inside the channel.

In still other embodiments, when the cathode is externally located with respect to the second region and inside the entrant channel, the discontinuity creates a space current, $I_b$, by configuring the magnetron as follows:

$$I_b = I_0 \frac{(\Gamma - \gamma_b)}{\gamma_b} \frac{\sqrt{\gamma_b^2 - 1}}{2\ln\left(\frac{R_a}{R_c}\right)}$$

where $$I_0 = \frac{mc^3}{e} \approx 17{,}000 \text{ Amperes},$$

$\Gamma=1+eU/mc^2$, $\gamma_b=-0.5+\sqrt{2\Gamma+0.25}$, m is the electron mass, e is the electron charge, c is the speed of light in vacuum, $R_c$ is the radius, $R_a$ is the radius of the second region, and U is the electrostatic potential of the anode.

For embodiments where the cathode is externally located with respect to the channel, the dimensional discontinuity creates a space limiting current, $I_{SCL}$, by configuring the magnetron as follows:

$$I_{SCL} = I_0 \frac{(\gamma^{2/3} - 1)^{3/2}}{1 + 2\ln\left(\frac{R_a}{R_b}\right)}$$

where $$I_0 = \frac{mc^3}{e} \approx 17{,}000 \text{ Amperes},$$

$R_a$ is the radius of the second region, where $R_b$ is the radius of the electron beam, and U is the electrostatic potential of the anode.

In further embodiments, the discontinuity creates a space limiting current, $I_{SCL}$ by configuring the magnetron as follows: ln $$\left(\frac{R_a}{R_b}\right)$$

where $R_a$ is the radius of the second region and $R_b$ is the radius of the electron beam.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiments, methods, and examples, but by all embodiments and methods within the scope and spirit of the disclosure.

What is claimed is:

1. A relativistic magnetron comprising:

an anode with an entrant channel, said channel having an input end, an output end, said channel having a first region and a second region, said first region in communication with said second region and having a smaller radius than said second region, said first and second regions forming a dimensional discontinuity at the location where said channel changes from said first region to said second region, said dimensional discontinuity located between said input and output ends of said channel;

said channel connected to the magnetron anode defining an interaction space located between said dimensional discontinuity and said output end;

a cathode located upstream a spaced distance away from said interaction space towards said input end, said cathode adapted to send an electron beam into said interaction space; and said electron beam forms a virtual cathode in said interaction space.

2. The device of claim 1 wherein said channel is cylindrical and said first region has a smaller radius than said second region.

3. The device of claim 2 wherein said first region is connected to said second region.

4. The device of claim 1 wherein said cathode is externally located with respect to said second region and inside said entrant channel.

5. The device of claim 2 wherein said cathode is externally located with respect to said second region and inside said channel.

6. The device of claim 5 wherein said dimensional discontinuity creates a space limiting current that is less than the current of the electron beam.

7. The device of claim 6 wherein said dimensional discontinuity creates a space limiting current, $I_b$, by configuring said magnetron as follows:

$$I_b = I_0 \frac{(\Gamma - \gamma_b)}{\gamma_b} \frac{\sqrt{\gamma_b^2 - 1}}{2\ln\left(\frac{R_a}{R_c}\right)}$$

where $$I_0 = \frac{mc^3}{e} \approx 17{,}000 \text{ Amperes},$$

$\Gamma=1+eU/mc^2$, $\gamma_b=-0.5+\sqrt{2\Gamma+0.25}$, m is the electron mass, e is the electron charge, c is the speed of light in vacuum, $R_c$ is the radius, $R_a$ is the radius of the second region, and U is the electrostatic potential of the anode.

8. The device of claim 1 wherein said cathode is externally located with respect to said channel.

9. The device of claim 8 wherein said dimensional discontinuity creates a space limiting current, $I_b$, by configuring said magnetron as follows:

$$I_{SCL} = I_0 \frac{(\gamma^{2/3} - 1)^{3/2}}{1 + 2\ln\left(\frac{R_a}{R_b}\right)}$$

where $I_0=mc^2/e\approx17{,}000$ Amperes, $R_a$ is the radius of the second region, where $R_b$ is the radius of the electron beam, and U is the electrostatic potential of the anode.

10. The device of claim 8 wherein said dimensional discontinuity creates a space limiting current, $I_{SCL}$, by configuring said magnetron as follows: ln $$\left(\frac{R_a}{R_b}\right)$$

where $R_a$ is the radius of the second region and $R_b$ is the radius of the electron beam.

11. A method of creating a virtual cathode in a relativistic magnetron comprising the steps of:

providing an anode defining an entrant channel, said channel having an input end, an output end, said channel having a first region and a second region, said first region is smaller in size than said second region, said first and second regions forming a dimensional discontinuity at the location where said channel transitions from said first region to said second region, said dimensional discontinuity located between said input and output ends of said channel;

said channel leading to an interaction space located between said dimensional discontinuity and said magnetron output end;

locating a cathode upstream away from said interaction space, said cathode adapted to send an electron beam having a current into said interaction space; and forming a virtual cathode in said interaction space by configuring said dimensional discontinuity to create a space limiting current that is less than said current of said electron beam.

12. The method of claim 11 wherein said cathode is located inside said entrant channel and upstream from said interaction space towards said input end.

13. The method of claim 12 wherein said dimensional discontinuity creates a space limiting current, $I_b$, by configuring said magnetron as follows:

$$I_b = I_0 \frac{(\Gamma - \gamma_b)}{\gamma_b} \frac{\sqrt{\gamma_b^2 - 1}}{2\ln\left(\frac{R_a}{R_c}\right)}$$

where $$I_0 = \frac{mc^3}{e} \approx 17{,}000 \text{ Amperes},$$

$\Gamma=1+eU/mc^2$, $\gamma_b=-0.5+\sqrt{2\gamma+0.25}$, m is the electron mass, e is the electron charge, c is the speed of light in vacuum, $R_c$ is the radius, $R_a$ is the radius of the second region, and U is the electrostatic potential of the anode.

14. The method of claim 11 wherein said cathode is located externally from said channel.

15. The method of claim 14 wherein said dimensional discontinuity creates a space limiting current, $I_{SCL}$, by configuring said magnetron as follows:

$$I_{SCL} = I_0 \frac{(\gamma^{2/3} - 1)^{3/2}}{1 + 2\ln\left(\frac{R_a}{R_b}\right)}$$

where $$I_0 = \frac{mc^3}{e} \approx 17{,}000 \text{ Amperes},$$

$R_a$ is the radius of the second region, where $R_b$ is the radius of the electron beam, and U is the electrostatic potential of the anode.

16. The method of claim 14 wherein said dimensional discontinuity creates a space limiting current, $I_{SCL}$, by configuring said magnetron as follows: ln $$\left(\frac{R_a}{R_b}\right)$$

where $R_a$ is the radius of the second region and $R_b$ is the radius of the electron beam.

17. A relativistic magnetron comprising:

an anode with an entrant channel, said channel having an input end, an output end, said channel having a first region and a second region, said first region is smaller in size than said second region, said first and second regions forming a dimensional discontinuity at the location where said channel transitions from said first region to said second region, said dimensional discontinuity located between said input and output ends of said channel and said dimensional discontinuity creates a space limiting current that is less than the current of the electron beam;

said channel connected to said anode defining an interaction space located between said dimensional discontinuity and said output end;

a cathode located upstream a spaced distance away from said interaction space towards said input end and said cathode is externally located with respect to said channel, said cathode adapted to send an electron beam into said interaction space; and said electron beam forms a virtual cathode in said interaction space.

* * * * *